US011469538B2

(12) United States Patent
Oosaka

(10) Patent No.: US 11,469,538 B2
(45) Date of Patent: Oct. 11, 2022

(54) BOARD-TO-BOARD ELECTRICAL CONNECTOR ASSEMBLY WITH PLATE PORTIONS ON THE CONNECTOR AND MATING CONNECTORS

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/236,368

(22) Filed: Apr. 21, 2021

(65) Prior Publication Data

US 2021/0359460 A1 Nov. 18, 2021

(30) Foreign Application Priority Data

May 13, 2020 (JP) ..... JP2020-084468
May 26, 2020 (JP) ..... JP2020-091146

(51) Int. Cl.
*H01R 13/518* (2006.01)
*H01R 13/6582* (2011.01)
(Continued)

(52) U.S. Cl.
CPC ..... *H01R 13/518* (2013.01); *H01R 13/502* (2013.01); *H01R 13/6582* (2013.01);
(Continued)

(58) Field of Classification Search
CPC ..... H01R 13/518; H01R 13/502; H01R 13/6582; H01R 12/71; H01R 13/658;
(Continued)

(56) References Cited

U.S. PATENT DOCUMENTS

2021/0111521 A1 4/2021 Amemori et al.
2021/0175649 A1* 6/2021 Amemori ..... H01R 12/712
2021/0242617 A1 8/2021 Ji et al.

FOREIGN PATENT DOCUMENTS

CN 109217031 A 1/2019
CN 110534939 A 12/2019
(Continued)

OTHER PUBLICATIONS

Office Action dated Mar. 29, 2022 issued in Taiwanese patent application No. 110114655 along with a corresponding English translation.

*Primary Examiner* — Abdullah A Riyami
*Assistant Examiner* — Justin M Kratt
(74) *Attorney, Agent, or Firm* — Greenblum & Bernstein, P.L.C.

(57) ABSTRACT

In a connector assembly in which a connector that includes a ground terminal including a plate portion and a mating connector that includes a mating ground terminal including a mating plate portion are fitted to each other, the plate portion and the mating plate portion have plate surfaces that are parallel to each other, the plate portion is composed of a pair of U-shaped portions that are adjacent to each other, the mating plate portion is shaped to have a pair of projection portions forming a concave portion therebetween, the projection portions formed in a pair are respectively positioned in U shapes of the pair of U-shaped portions, each of leg portions of the mutually-adjacent U shapes in the pair of U-shaped portions is positioned in the concave portion, and protrusion portions of the leg portions are respectively in contact with the projection portions.

8 Claims, 18 Drawing Sheets

(51) Int. Cl.

| | |
|---|---|
| ***H01R 13/502*** | (2006.01) |
| ***H01R 13/6585*** | (2011.01) |
| *H01R 12/71* | (2011.01) |
| *H01R 13/658* | (2011.01) |
| *H01R 12/73* | (2011.01) |
| *H01R 13/6581* | (2011.01) |
| *H01R 13/6591* | (2011.01) |
| *H01R 13/6594* | (2011.01) |
| *H01R 13/652* | (2006.01) |
| *H01R 24/00* | (2011.01) |

(52) U.S. Cl.
CPC ..... *H01R 13/6585* (2013.01); *H01R 12/71* (2013.01); *H01R 12/73* (2013.01); *H01R 13/652* (2013.01); *H01R 13/658* (2013.01); *H01R 13/6581* (2013.01); *H01R 13/6591* (2013.01); *H01R 13/6594* (2013.01); *H01R 24/00* (2013.01)

(58) Field of Classification Search
CPC .. H01R 13/6594; H01R 12/73; H01R 13/652; H01R 13/6581; H01R 24/00; H01R 13/6591; H01R 13/6585
See application file for complete search history.

(56) References Cited

FOREIGN PATENT DOCUMENTS

| | | | |
|---|---|---|---|
| JP | 2019-121439 | | 7/2019 |
| JP | 6635242 | | 1/2020 |
| TW | 201530919 | A | 8/2015 |
| WO | 2020003731 | | 1/2020 |

* cited by examiner

BOARD-TO-BOARD ELECTRICAL CONNECTOR ASSEMBLY WITH PLATE PORTIONS ON THE CONNECTOR AND MATING CONNECTORS

TECHNICAL FIELD

The present invention relates to a connector assembly in which a connector and a mating connector are opposed and fitted to each other.

BACKGROUND ART

FIG. 1 illustrates a connector assembly that is referred to as an "electrical connector set" in Japanese Registered Patent No. 6635242. FIGS. 2A and 2B respectively illustrate a second connector 20 and a first connector 10 constituting a connector assembly 30 illustrated in FIG. 1.

In the connector assembly 30, a wall-like terminal 33 is interposed between a first engagement terminal 31 and second engagement terminals 32*a* to 32*f*. The first engagement terminal 31 is structured by spring-engaging a first convex terminal 11 of the first connector 10 with a first concave terminal 21 of the second connector 20. The second engagement terminals 32*a* to 32*f* are structured by respectively spring-engaging second convex terminals 12*a* to 12*f* of the first connector 10 with second concave terminals 22*a* to 22*f* of the second connector 20. The wall-like terminal 33 is structured by engaging a first partial wall terminal 13 of the first connector 10 with a second partial wall terminal 23 of the second connector 20.

FIG. 3 illustrates an arrangement relation among the first engagement terminal 31, the second engagement terminals 32*a* to 32*f*, and the wall-like terminal 33, and FIG. 4 illustrates the wall-like terminal 33 that is composed of the first partial wall terminal 13 and the second partial wall terminal 23. The wall-like terminal 33 is structured as the first partial wall terminal 13 and the second partial wall terminal 23 are brought into close contact with each other as illustrated in FIG. 4.

The first engagement terminal 31 is used for high frequency transmission, and providing the wall-like terminal 33 between the first engagement terminal 31 and the second engagement terminals 32*a* to 32*f* enables shielding against electromagnetic waves radiated from the first engagement terminal 31.

In the above-described connector assembly 30 composed of the first connector 10 and the second connector 20, the wall-like terminal 33 shielding electromagnetic waves radiated from the first engagement terminal 31 used for high frequency transmission is structured by stacking the first partial wall terminal 13 of the first connector 10 and the second partial wall terminal 23 of the second connector 20 in the plate thickness direction thereof. Thus, the stacking in the plate thickness direction automatically causes dimensional increase of the connector assembly 30 in the plate thickness direction.

BRIEF SUMMARY OF THE INVENTION

An object of the present invention is to provide a connector assembly, having a shield for blocking electromagnetic interference between terminals, that is reduced in size compared to the related art.

A plate portion of one connector and a plate portion of the other connector are combined with each other. Consequently, the plate portion of one connector and the plate portion of the other connector constitute a shield for blocking electromagnetic interference between terminals.

Effects of the Invention

According to the connector assembly of the present invention, a shield for blocking electromagnetic interference between terminals can be reduced in dimension in the thickness (plate thickness) direction thereof compared to the related art, accordingly realizing downsizing of the connector assembly.

LIST OF REFERENCE NUMERALS

Figure 1:
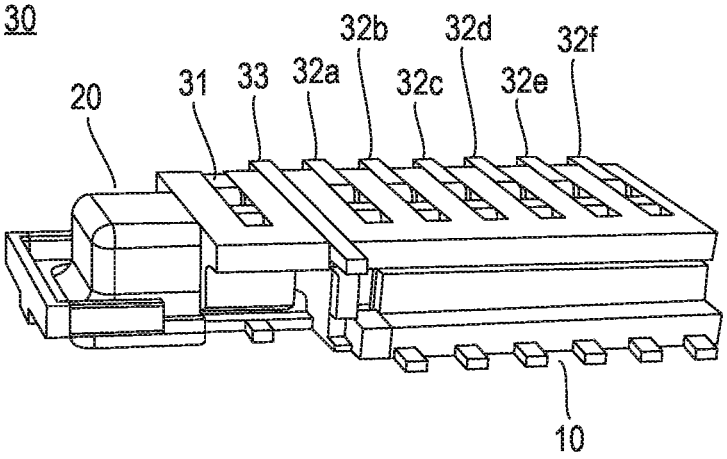
FIG. 1 (PRIOR ART)
FIG. 1 is a perspective view illustrating a conventional example of a connector assembly.
Figure 2A:
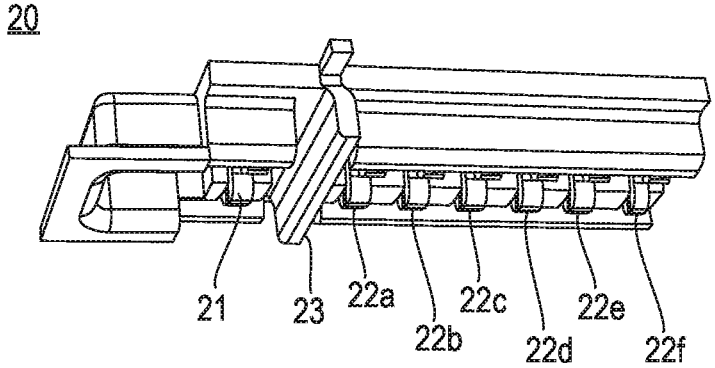
FIG. 2A (PRIOR ART)
FIG. 2A is a perspective view illustrating a second connector constituting the connector assembly illustrated in FIG. 1.
Figure 2B:
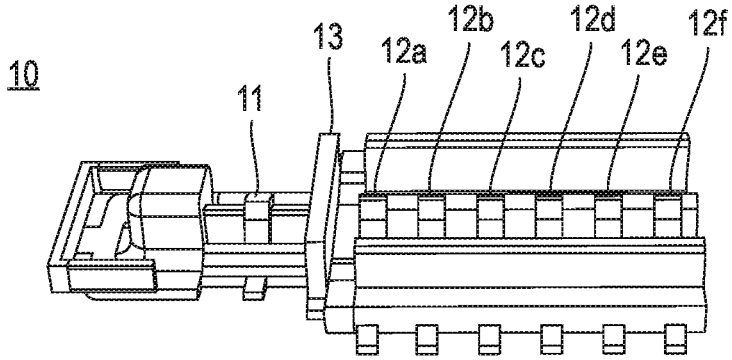
FIG. 2B (PRIOR ART)
FIG. 2B is a perspective view illustrating a first connector constituting the connector assembly illustrated in FIG. 1.
Figure 3:
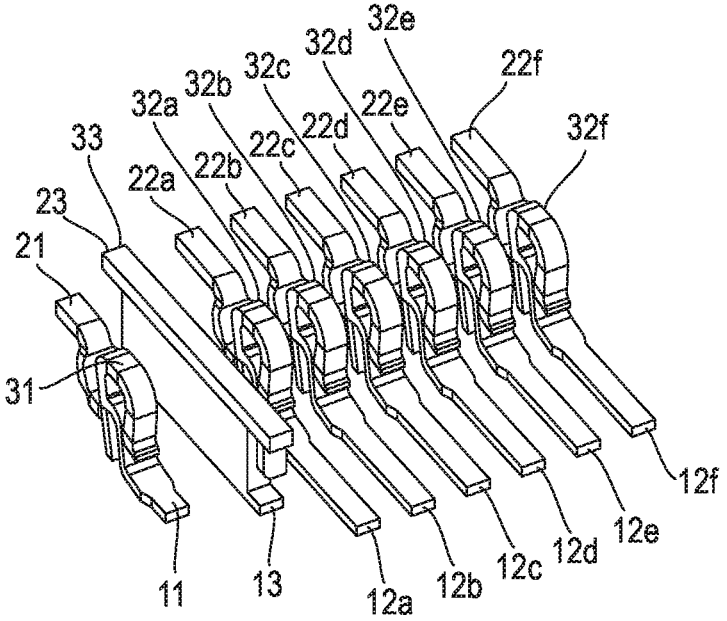
FIG. 3 (PRIOR ART)
FIG. 3 is a perspective view illustrating an arrangement relation among terminals illustrated in FIG. 1.
Figure 4:
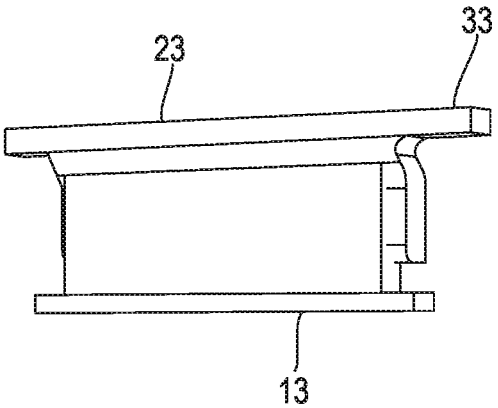
FIG. 4 (PRIOR ART)
FIG. 4 is a perspective view illustrating a wall-like terminal illustrated in FIG. 1.
Figure 5A:
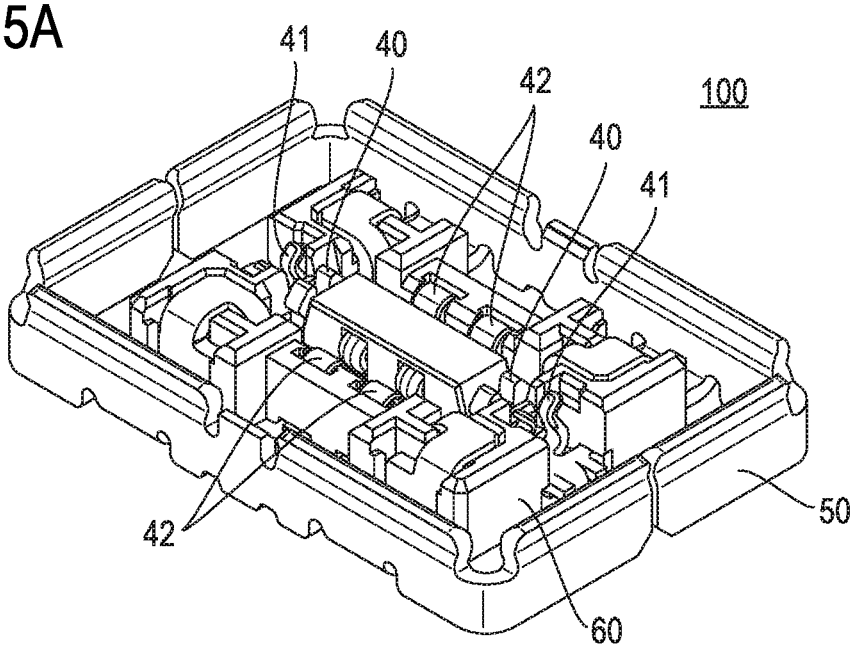
FIG. 5A is an upper perspective view illustrating one connector constituting a connector assembly according to a first embodiment of the present invention.
Figure 5B:
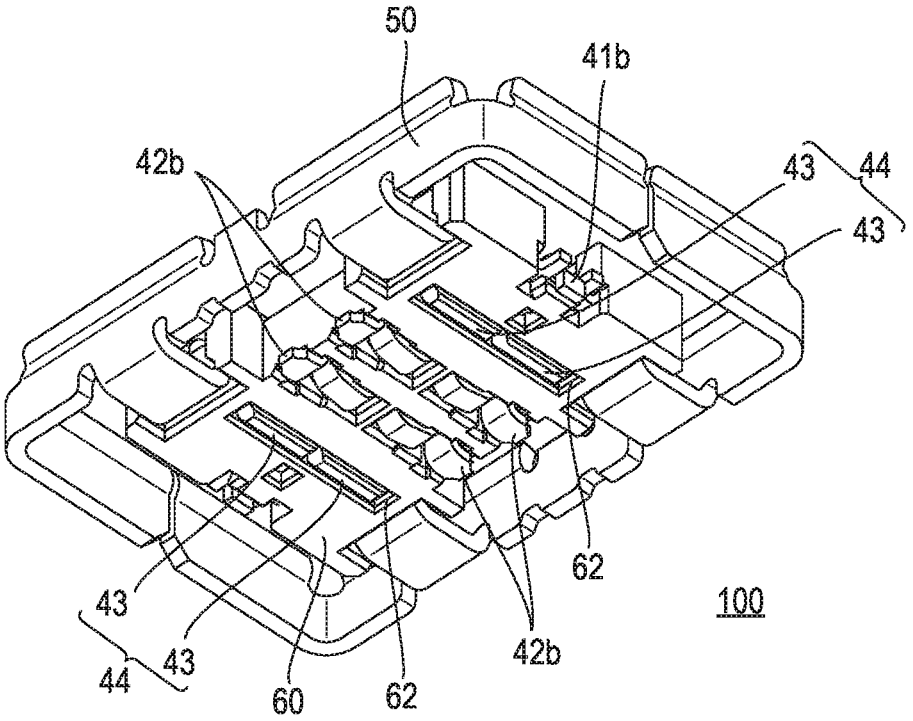
FIG. 5B is a lower perspective view illustrating the connector illustrated in FIG. 5A.
Figure 6A:
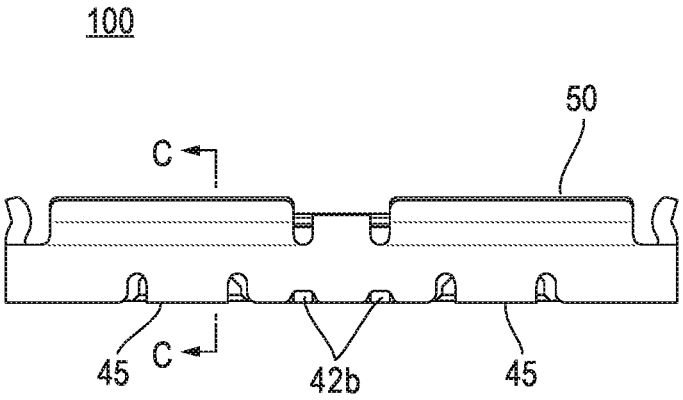
FIG. 6A is a front elevational view illustrating the connector illustrated in FIG. 5A.
Figure 6B:
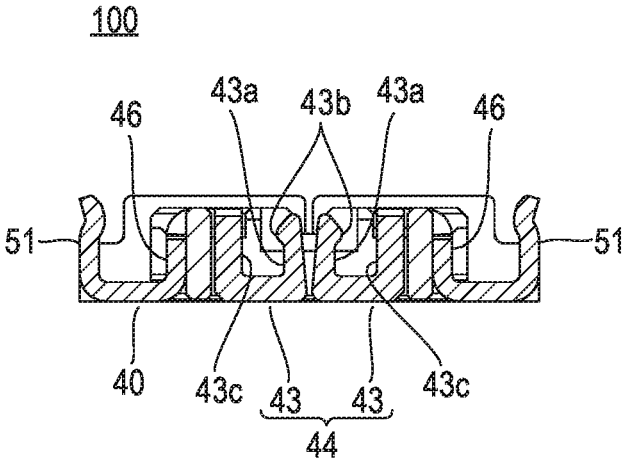
FIG. 6B is a sectional view taken along the C-C line in FIG. 6A.

10: first connector
11: first convex terminal
12*a* to 12*f*: second convex terminal
13: first partial wall terminal
20: second connector
21: first concave terminal
22*a* to 22*f*: second concave terminal
23: second partial wall terminal
30: connector assembly
31: first engagement terminal
32*a* to 32*f*: second engagement terminal
33: wall-like terminal
40, 40', 40": ground terminal
41: first terminal
41*a*: contact piece
41*b*: connection portion
42: second terminal
42*a*: contact piece
42*b*: connection portion
43: U-shaped portion
43*a*: leg portion
43*b*: protrusion portion
43*c*: leg portion
43*d*: protrusion
43*e*: opposing surface
44: plate portion
45: coupling portion
46: held portion
46*a*: protrusion
47: extension portion
48: extension portion
49: projection portion
50, 50', 50": shell
51, 52: outer wall portion
51*a*, 52*a*: curved portion
53, 54: cutout
55: protrusion
60, 60': insulator
61: concave portion
62: slit
63: groove
64: concave portion
70: mating ground terminal
71: first mating terminal
71*a*: connection portion
72: second mating terminal
72*a*: connection portion
73: mating plate portion
74: concave portion
75: projection portion
76: coupling portion
77: extension portion
80: mating shell
81, 82: outer wall portion
81*a*, 82*a*: convex portion
81*b*: extension portion
82*b*: protrusion
83: coupling portion
84, 85: cutout
90: mating insulator
91: bottom plate portion
92: side wall
93: concave portion
100, 100', 100": connector
200: mating connector

DETAILED DESCRIPTION

Embodiments of the present invention will be described based on examples with reference to the accompanying drawings.

First Embodiment

Figure 7:
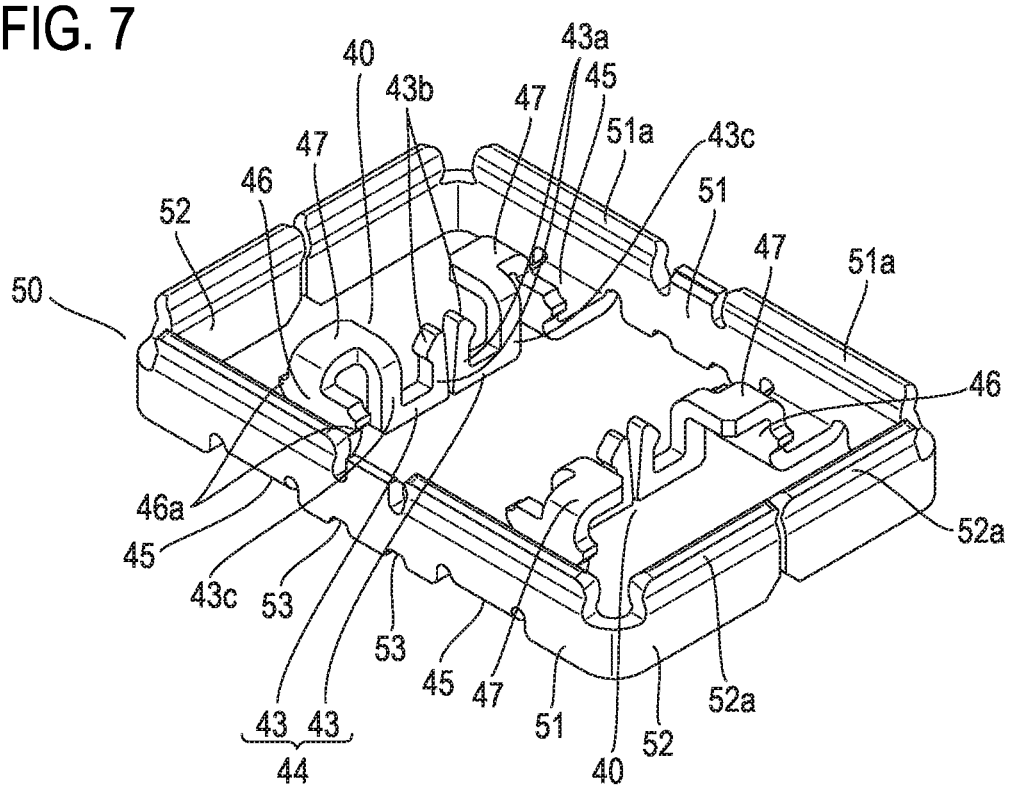
FIG. 7 is a perspective view illustrating ground terminals integrated with a shell illustrated in FIG. 5A.
Figure 8:
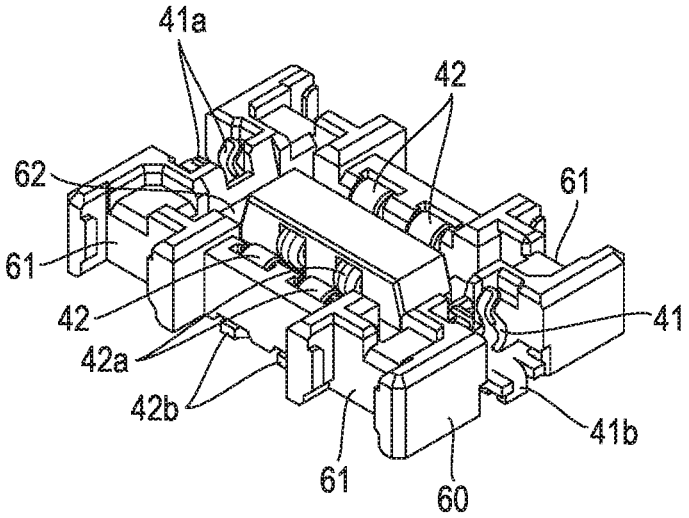
FIG. 8 is a perspective view illustrating an insulator and terminals held by the insulator illustrated in FIG. 5A.
Figure 9A:
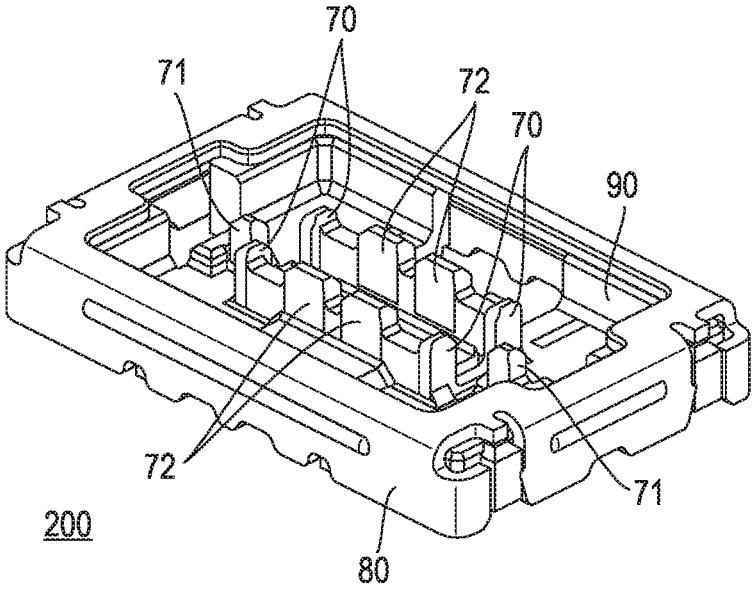
FIG. 9A is an upper perspective view illustrating a mating connector constituting the connector assembly according to the first embodiment of the present invention.
Figure 9B:
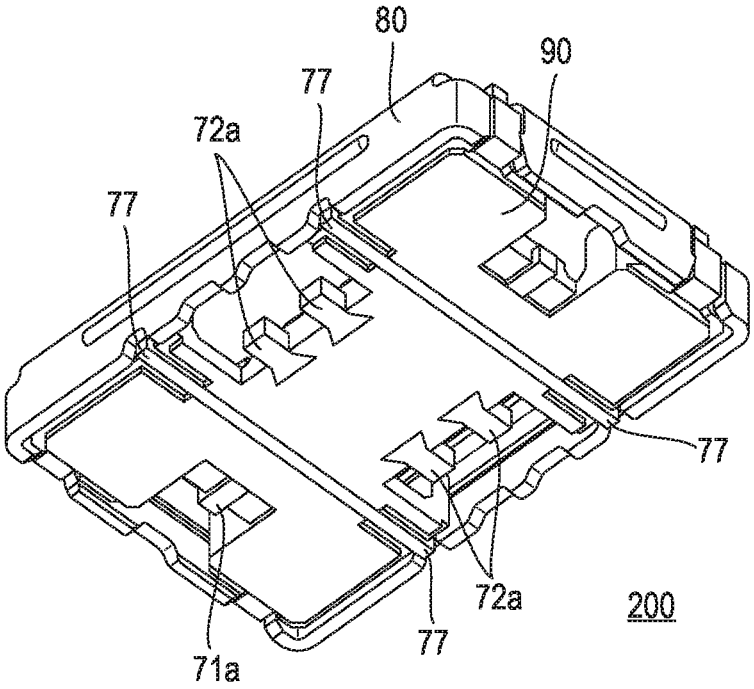
FIG. 9B is a lower perspective view illustrating the mating connector illustrated in FIG. 9A.

FIGS. 5A, 5B, 6A, and 6B illustrate one connector 100 constituting a connector assembly according to a first embodiment of the present invention. The connector 100 is composed of first terminals 41, second terminals 42, ground terminals 40, a shell 50, and an insulator 60. The ground terminals 40 are integrally formed with the shell 50 which is the outer shell of the connector 100 in this example. FIG. 7 illustrates details of the ground terminals 40 and the shell 50 that are mutually integrally formed, and FIG. 8 illustrates the insulator 60 and the first and second terminals 41 and 42 that are held by the insulator 60.

The insulator 60 is made of resin and has a substantially rectangular parallelepiped shape as a whole. The first terminals 41 are respectively attached to both longitudinal end portions of the insulator 60, and two second terminals 42 for each of two columns, that is, four second terminals 42 in total are attached to the central portion of the insulator 60.

The first terminal 41 includes a pair of contact pieces 41*a* which face each other, and the second terminal 42 also includes a pair of contact pieces 42*a* which face each other. Connection portions 41*b* and 42*b*, which are to be connected with a board, of the first terminals 41 and second terminals 42 are positioned on the bottom surface side of the insulator 60. The two first terminals 41 are used for high frequency signals (high speed transmission) and the four second terminals 42 are used for low frequency signals (low speed transmission) in this example.

The shell 50 having conductivity is formed through processing for metal plate bending and a rectangular frame structure thereof is composed of two bodies having U-shaped outer walls. Curved portions 51*a* and curved portions 52*a* are formed respectively on upper ends of outer wall portions 51 positioned on two opposed long sides of the rectangle and on upper ends of outer wall portions 52 positioned on two opposed short sides of the rectangle. The curved portions 51*a* and 52*a* are curved to slightly protrude toward the inside of the frame.

Two ground terminals 40, which are integrated with the shell 50, are formed in the frame of the shell 50 and both ends of the ground terminal 40 are coupled and supported with the outer wall portions 51 which are opposed to each other. The ground terminals 40 are respectively provided on two spots in the longitudinal direction of the shell 50.

The ground terminal 40 includes a plate portion 44 composed of a pair of U-shaped portions 43 that have U shapes opening upward and are positioned side by side on the same plane. On end sides of leg portions 43*a* of mutually-adjacent U shapes in the pair of U-shaped portions 43, protrusion portions 43*b* are formed in a manner to protrude mutually outward.

The ground terminal 40 is composed of the above-mentioned plate portion 44, coupling portions 45, held portions 46, and extension portions 47. The coupling portions 45 have shapes respectively bent and extended from lower ends of the outer wall portions 51, which are opposed to each other, toward the inside of the frame. The held portions 46 are bent and raised from the coupling portions 45 respectively. The extension portions 47 are extended from the upper ends of respective held portions 46 to the ends of leg portions 43*c* positioned on the mutual outer sides of the pair of U-shaped portions 43. In addition, a pair of protrusions 46*a* are formed on each held portion 46 in a manner to respectively protrude in the width direction.

Two small cutouts 53 are formed on part between two coupling portions 45 on the lower end of each outer wall portion 51. The cutouts 53 are formed to respectively correspond to the positions of the connection portions 42*b* of the second terminals 42. The connection portions 42*b* are exposed to the bottom surface side of the insulator 60 in a manner to be held by the insulator 60.

The shell 50 with which the ground terminals 40 are integrally formed as described above is attached to the insulator 60 holding the first terminals 41 and the second terminals 42. The attachment of the shell 50 is performed by putting the shell 50 over the insulator 60 and forcing the shell 50 into the insulator 60. At this time, the pairs of held portions 46 including the protrusions 46*a* in two ground terminals 40 are pressed into four concave portions 61 of the insulator 60 and are fixed and held. In addition, the plate portions 44, each being composed of a pair of U-shaped portions 43, in two ground terminals 40 are respectively inserted into slits 62 of the insulator 60 so as to be positioned between the first terminals 41 and the second terminals 42. Thus, the connector 100 illustrated in FIGS. 5A, 5B, 6A, and 6B is completed.

A mating connector 200 that is fitted to the above-described connector 100 to constitute the connector assembly will now be described.

Figure 11:
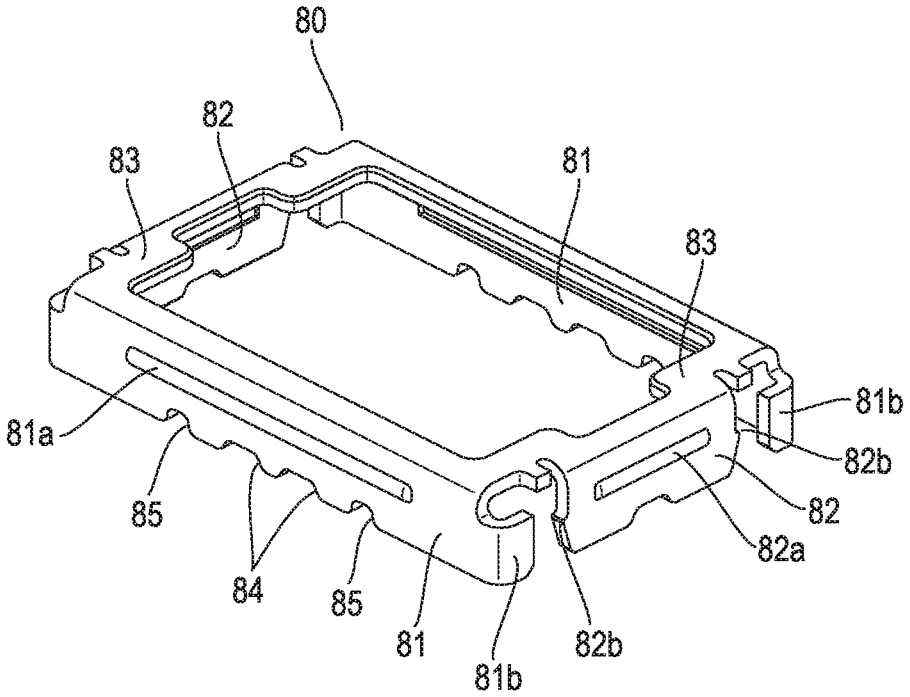
FIG. 11 is a perspective view illustrating a mating shell illustrated in FIG. 9A.
Figure 12:
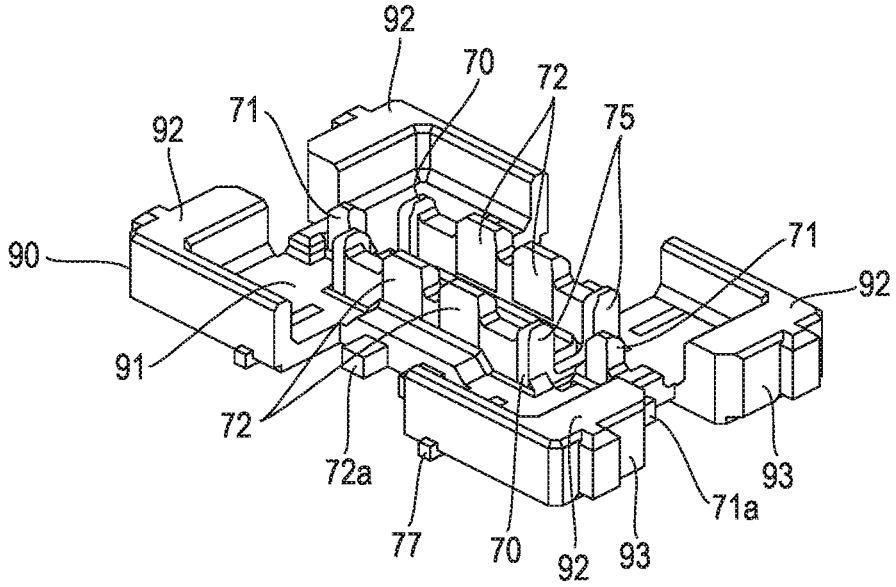
FIG. 12 is a perspective view illustrating a mating insulator and mating terminals held by the mating insulator illustrated in FIG. 9A.

FIGS. 9A, 9B, 10A, and 10B illustrate the mating connector 200. The mating connector 200 is composed of first mating terminals 71, second mating terminals 72, mating ground terminals 70, a mating shell 80, and a mating insulator 90. FIG. 11 illustrates details of the mating shell 80, and FIG. 12 illustrates a state in which the mating shell 80 is detached from the mating connector 200.

The mating insulator 90 is made of resin and includes a bottom plate portion 91 and side walls 92 which are respectively provided on four corner portions of the bottom plate portion 91. The first mating terminals 71 are respectively attached to both longitudinal end portions of the bottom plate portion 91, and two second mating terminals 72 for each of two columns, that is, four second mating terminals 72 in total are attached to the central portion of the bottom plate portion 91. Further, the mating ground terminal 70 is attached between each of the two first mating terminals 71 and the four second mating terminals 72.

The first mating terminal 71 has a columnar shape and includes a connection portion 71*a*, to be connected with a board, on the lower end thereof. The second mating terminal 72 has a plate-like shape and includes a connection portion 72*a*, to be connected with the board, on the lower end thereof. The two first mating terminals 71 are used for high frequency signals and the four second mating terminals 72 are used for low frequency signals.

Figure 10A:
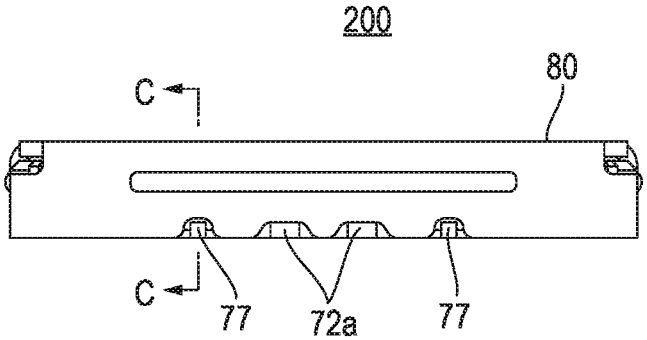
FIG. 10A is a front elevational view illustrating the mating connector illustrated in FIG. 9A.
Figure 10B:
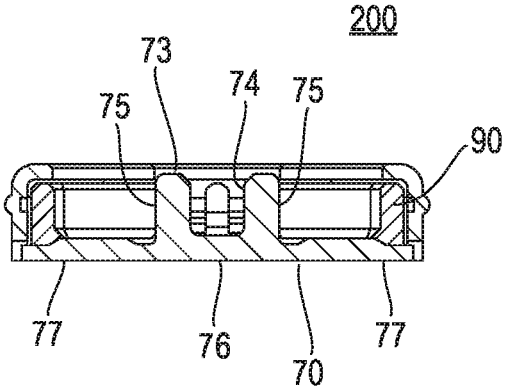
FIG. 10B is a sectional view taken along the C-C line in FIG. 10A.

As illustrated in FIG. 10B, the mating ground terminal 70 includes a mating plate portion 73 on the center in the longitudinal direction. The mating plate portion 73 is shaped to have a pair of projection portions 75 forming a concave portion 74, which opens upward, therebetween. The pair of projection portions 75 protrude from the bottom plate portion 91 of the mating insulator 90. In the mating plate portion 73, a coupling portion 76 coupling the lower ends of the pair of projection portions 75 is positioned and exposed on the bottom surface side of the mating insulator 90. The mating ground terminal 70 is composed of the mating plate portion 73 having the above-described structure and extension portions 77 which are respectively extended from both ends of the coupling portion 76 of the mating plate portion 73. The mating plate portions 73 of the two mating ground terminals 70 are respectively positioned between the first mating terminals 71 and the second mating terminals 72.

The mating shell 80 which has a rectangular frame-like shape and has conductivity is formed through processing for metal plate bending. As illustrated in FIG. 11, the mating shell 80 includes outer wall portions 81, outer wall portions 82, and a pair of coupling portions 83. The outer wall portions 81 are respectively positioned on two opposed long sides of the rectangle. The outer wall portions 82 are respectively positioned on two opposed short sides of the rectangle. The coupling portions 83 couple the upper ends of the outer wall portions 81 and the upper ends of the outer wall portions 82 to each other. The pair of coupling portions 83 include plate surfaces that partially close both longitudinal ends of the rectangular frame.

Elongated convex portions 81*a* are respectively formed on the outer surfaces of the pair of outer wall portions 81 in a manner to be extended in the side direction, and elongated convex portions 82*a* are also respectively formed on the outer surfaces of the pair of outer wall portions 82 in a manner to be extended in the side direction. Extension portions 81*b* are formed on both ends in the side direction of the pair of outer wall portions 81 in a manner to be bent toward the outer wall portion 82.

Two cutouts 84 are formed on the lower end of each outer wall portion 81, and cutouts 85 are further formed on both outer sides in the side direction of the two cutouts 84. The cutouts 84 are formed to correspond to the positions of the connection portions 72*a* of the second mating terminals 72. The connection portions 72*a* are exposed on the bottom surface side of the mating insulator 90 in a manner to be held by the mating insulator 90. The cutouts 85 are formed to correspond to the positions of the extension portions 77 of the mating ground terminals 70. The extension portions 77 are exposed on the bottom surface side of the mating insulator 90 in a manner to be held by the mating insulator 90. Protrusions 82*b* are formed in a manner to protrude outward from both ends in the side direction of each outer wall portion 82.

The mating shell 80 having the above-described structure is attached to the mating insulator 90 that holds the first mating terminals 71, the second mating terminals 72, and the mating ground terminals 70. The attachment of the mating shell 80 is performed by putting the mating shell 80 over the mating insulator 90 and forcing the mating shell 80 into the mating insulator 90. Each of the outer wall portions 82 including the protrusions 82*b* is pressed into a concave portion 93 which is formed on the outer sides of side walls 92 of the mating insulator 90 in a manner to straddle two side walls 92. As a result, the mating connector 200 illustrated in FIGS. 9A, 9B, 10A, and 10B is completed.

The above-described connector 100 and mating connector 200 constitute a board-to-board connector in which the connector 100 and the mating connector 200 are respectively mounted on opposing surfaces of boards, which are opposed to each other, and fitted and connected to each other. In the connector 100, the connection portions 41*b* and 42*b* of the first terminals 41 and second terminals 42, portions, which are exposed on the bottom surface of the insulator 60, of the plate portions 44 of the ground terminals 40 (intermediate portions of the U shape of the pair of U-shaped portions 43), and the shell 50 are soldered and connected to corresponding pad or pattern of the boards.

On the other hand, in the mating connector 200, the connection portions 71*a* and 72*a* of the first mating terminals 71 and second mating terminals 72, the coupling portions 76 of the mating plate portion 73 and the extension portions 77 of the mating ground terminals 70, and further, the mating shell 80 are soldered and connected to corresponding pad or pattern of the boards.

FIGS. 13A, 13B, 13C, and 13D illustrate a connector assembly according to the present invention in which the connector 100 and the mating connector 200 are fitted to each other, and the drawings omit illustration of boards.

Through the fitting of the mating connector 200 to the connector 100, the first terminals 41 and the second terminals 42 are respectively fitted and connected to the first mating terminals 71 and the second mating terminals 72. Further, the convex portions 81*a* and 82*a* formed on the mating shell 80 ride over and fit in the curved portions 51*a* and 52*a* of the shell 50 respectively and thus, the mating shell 80 is fitted in the inside of the shell 50.

Figure 13A:
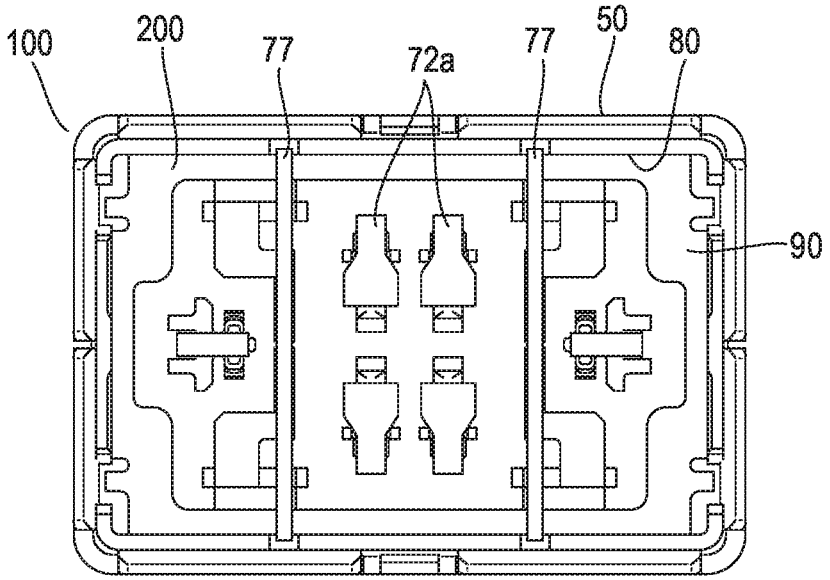
FIG. 13A is a plan view illustrating the connector assembly according to the first embodiment of the present invention.
Figure 13B:
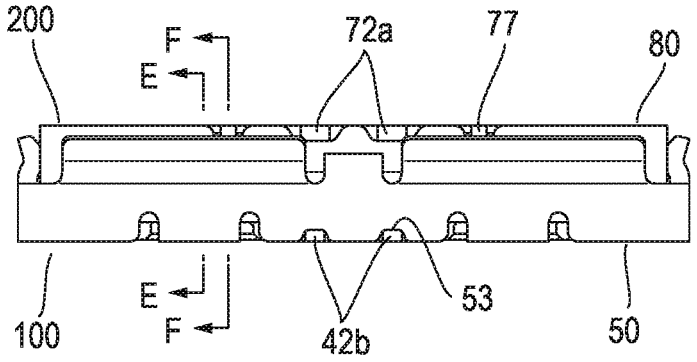
FIG. 13B is a front elevational view illustrating the connector assembly according to the first embodiment of the present invention.
Figure 13C:
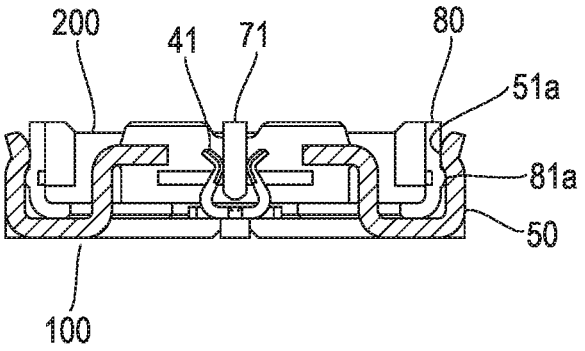
FIG. 13C is a sectional view taken along the E-E line in FIG. 13B.
Figure 13D:
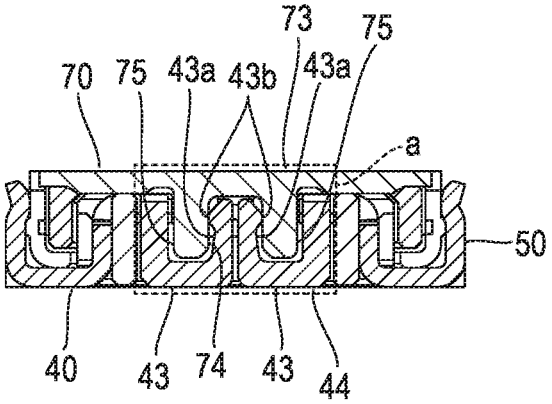
FIG. 13D is a sectional view taken along the F-F line in FIG. 13B.
Figure 14A:
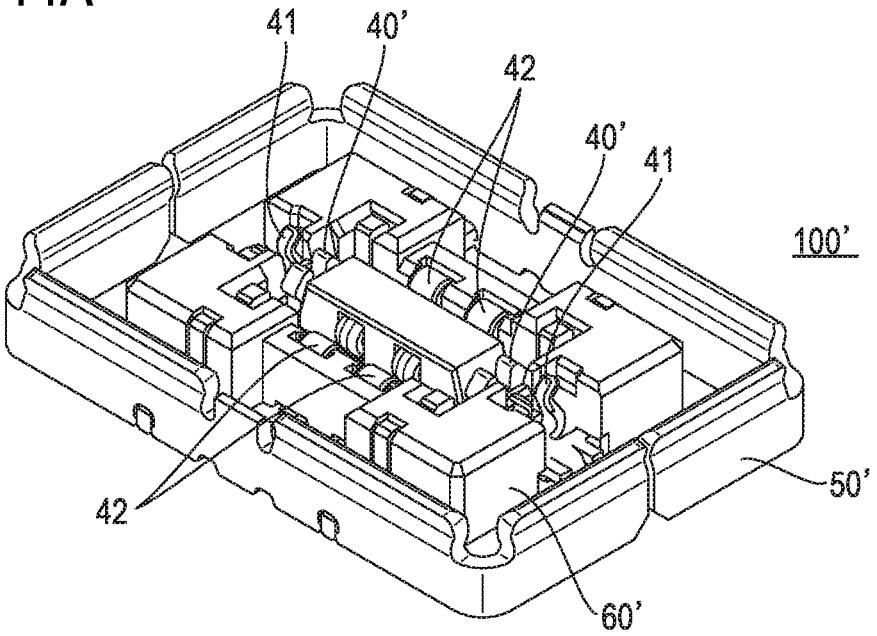
FIG. 14A is an upper perspective view illustrating one connector constituting a connector assembly according to a second embodiment of the present invention.
Figure 14B:
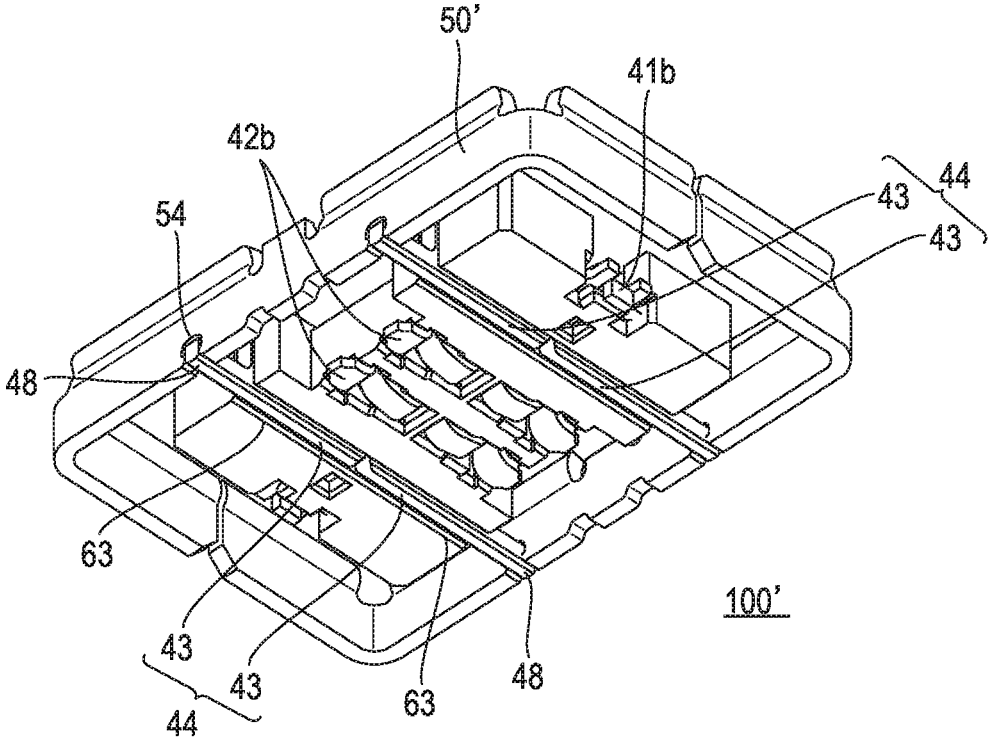
FIG. 14B is a lower perspective view illustrating the connector illustrated in FIG. 14A.
Figure 15A:
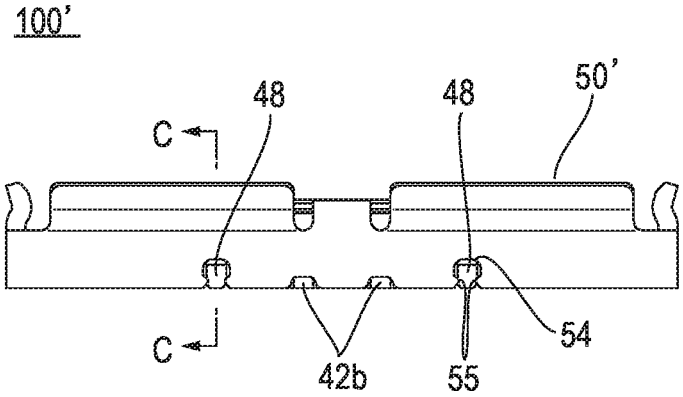
FIG. 15A is a front elevational view illustrating the connector illustrated in FIG. 14A.
Figure 15B:
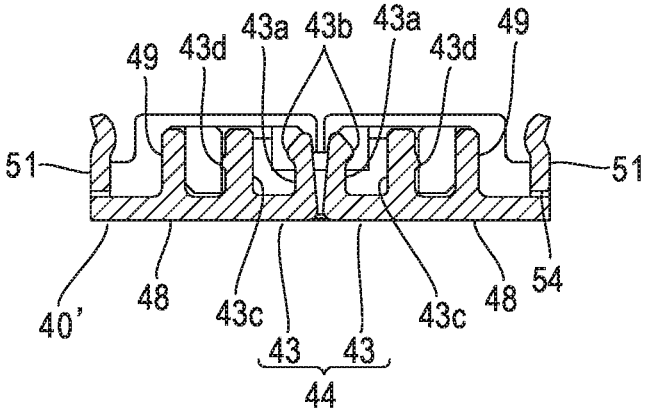
FIG. 15B is a sectional view taken along the C-C line in FIG. 15A.

On the other hand, the plate portion 44 of the ground terminal 40 and the mating plate portion 73 of the mating ground terminal 70 have plate surfaces that are parallel to each other and are parallel to the fitting direction of the connector 100 and the mating connector 200. As illustrated in FIG. 13D, the pair of projection portions 75 of the mating plate portion 73 is positioned so that the projection portions 75 are respectively inserted into U shapes of the pair of U-shaped portions 43 in the plate portion 44. Further, both of the leg portions 43*a* of mutually-adjacent U shapes in the pair of U-shaped portions 43 are inserted and positioned in the concave portion 74 of the mating plate portion 73. The leg portions 43*a* of mutually-adjacent U shapes elastically deform toward the mutually-approaching direction when inserted into the concave portion 74, and the protrusion portions 43*b*, which are formed on the end sides of the leg portions 43*a*, are respectively brought into elastic contact with the inner surfaces of the pair of projection portions 75 by elastic restoring force of the leg portions 43*a*. Accordingly, the plate portion 44 and the mating plate portion 73 are mutually conducted.

The plate portion 44 and the mating plate portion 73 are thus combined with each other to constitute a shield between a couple of the first terminal 41 and first mating terminal 71 for high frequency signals and couples of the second terminals 42 and second mating terminals 72 for low frequency signals, in this example. Part a surrounded by a dotted line in FIG. 13D represents the part in which the shield is constituted, and this shield blocks electromagnetic interference between terminals (between terminals for high frequency signals and terminals for low frequency signals, and between terminals for both high frequency signals).

The plate portion 44 and the mating plate portion 73 mutually have the same thickness (plate thickness) in this example, and the range within which the thickness of the plate portion 44 is located is accorded with the range within which the thickness of the mating plate portion 73 is located. That is, the plate portion 44 and the mating plate portion 73 are combined with each other as they form one plate. A gap between the plate portion 44 and the mating plate portion 73 and a gap between the leg portions 43*a*, which are inserted and positioned in the concave portion 74 of the mating plate portion 73, of adjacent U shapes of the plate portions 44 are set to be smaller than the thicknesses of the plate portion 44 and the mating plate portion 73. Accordingly, favorable shielding performance is secured in this example.

It is to be noted that the thickness of the plate portion 44 and the thickness of the mating plate portion 73 do not have to be always the same as each other. When having the mutually different thicknesses, the plate portion 44 and the mating plate portion 73 are combined with each other so that the range within which the thickness of one of the plate portion 44 and the mating plate portion 73 is located is within the range within which the thickness of the other is located. Thus, if the thickness of the plate portion 44 and the thickness of the mating plate portion 73 are different from each other, the gap between the plate portion 44 and the mating plate portion 73 and the gap between the leg portions 43*a*, positioned in the concave portion 74, of the U shapes are set smaller than the thickness of the plate portion 44 or the mating plate portion 73 which has the smaller thickness.

Second Embodiment

In the first embodiment described above, the ground terminals 40 and the shell 50 are integrally formed in one connector 100 constituting the connector assembly. However, ground terminals and a shell may be formed separately.

FIGS. 14A, 14B, 15A, and 15B illustrate a connector 100' in which ground terminals and a shell are formed separately as mentioned. Portions corresponding to those in the connector 100 illustrated in FIGS. 5A, 5B, 6A, and 6B will be provided with the same reference characters in FIGS. 14A, 14B, 15A, and 15B and detailed description thereof will be omitted.

Figure 16:
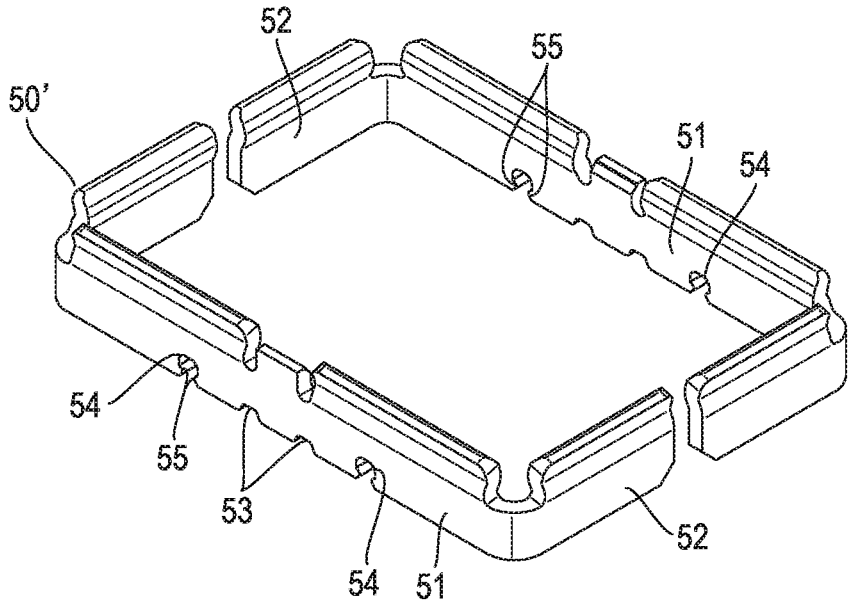
FIG. 16 is a perspective view illustrating a shell illustrated in FIG. 14A.
Figure 17:
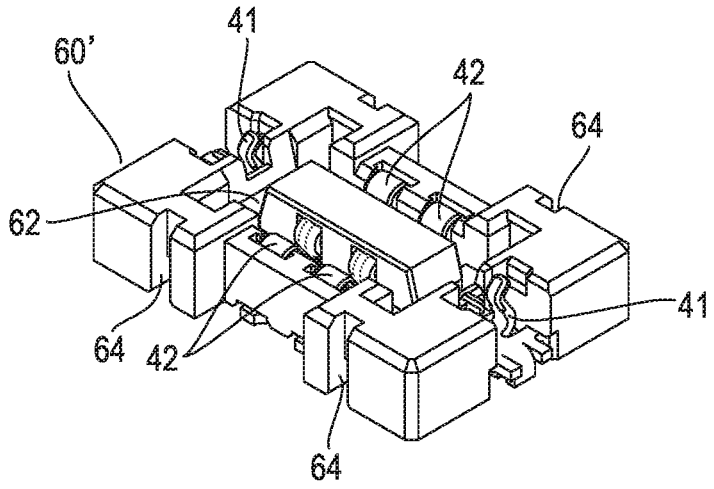
FIG. 17 is a perspective view illustrating an insulator and terminals held by the insulator illustrated in FIG. 14A.
Figure 18:
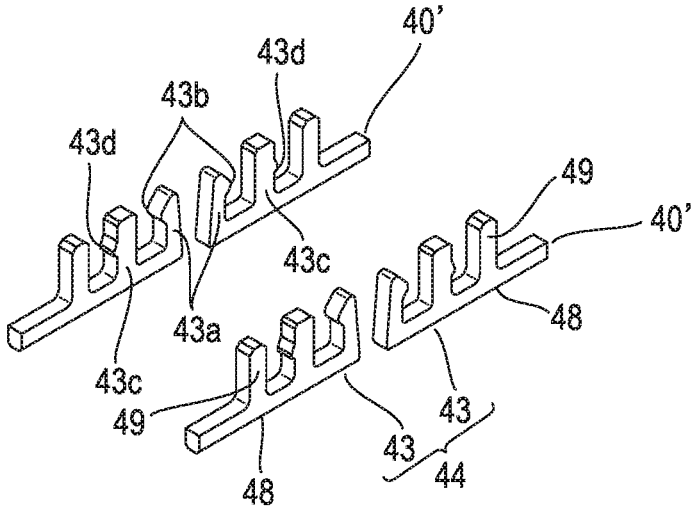
FIG. 18 is a perspective view illustrating ground terminals illustrated in FIG. 14A.

The connector 100' is composed of first terminals 41, second terminals 42, ground terminals 40', a shell 50', and an insulator 60'. FIGS. 16, 17, and 18 respectively illustrate details of the shell 50', the insulator 60' holding the first terminals 41 and the second terminals 42, and the ground terminals 40'.

The ground terminal 40' includes a plate portion 44 composed of a pair of U-shaped portions 43 on the center thereof and includes extension portions 48 which are extended mutually outward from the intermediate portions in the U shapes of the pair of U-shaped portions 43. Protrusions 43*d* are formed in a protruding manner respectively on outer surfaces of the leg portions 43*c* which are respectively positioned on the outer sides of the pair of U-shaped portions 43. Further, projection portions 49 are respectively formed on a pair of extension portions 48 so that the projection portions 49 face the leg portions 43*c*.

Two ground terminals 40' having the above-described shape are attached to the insulator 60' from the bottom surface side of the insulator 60'. At this time, the plate portions 44 are respectively inserted into two slits 62 of the insulator 60' to be positioned between the first terminals 41 and the second terminals 42. Further, the extension portions 48 are housed in grooves 63 (see FIG. 14B) which are formed on the bottom surface of the insulator 60' in a manner to be conducted with the slits 62. The projection portions 49 are positioned in a manner to be inserted into concave portions 64 which are formed on outer surfaces of the insulator 60'. The ground terminals 40' are attached and fixed on the insulator 60' by pinching the insulator 60' by the leg portions 43*c*, having the protrusions 43*d*, and the projection portions 49.

The shell 50' is composed of outer wall portions 51 and outer wall portions 52. On both outer sides in the side direction of two cutouts 53 on the lower end of each outer wall portion 51, cutouts 54 are respectively formed so that the cutouts 54 correspond to the positions of the extension portions 48 of the ground terminal 40' attached to the insulator 60' in this example. On the inner surfaces of the cutouts 54, protrusions 55 are respectively formed in a manner to protrude mutually inward.

The shell 50' is put over the insulator 60' holding the first terminals 41, the second terminals 42, and the ground terminals 40', thus being attached to the insulator 60'. The extension portions 48 of the two ground terminals 40' are respectively fitted in the cutouts 54 of the shell 50' and are pinched by the protrusions 55. Accordingly, the shell 50' is fixed to the ground terminals 40', that is, the shell 50' is attached and fixed on the insulator 60' via the ground terminals 40'. Thus, the connector 100' illustrated in FIGS. 14A, 14B, 15A, and 15B is completed.

Third Embodiment

Figure 19A:
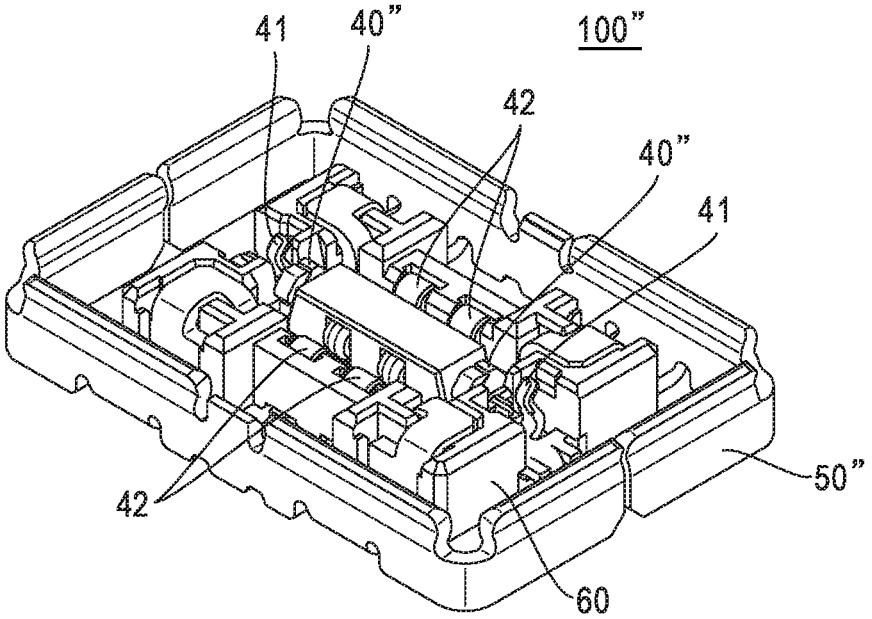
FIG. 19A is a perspective view illustrating one connector constituting a connector assembly according to a third embodiment of the present invention.
Figure 19B:
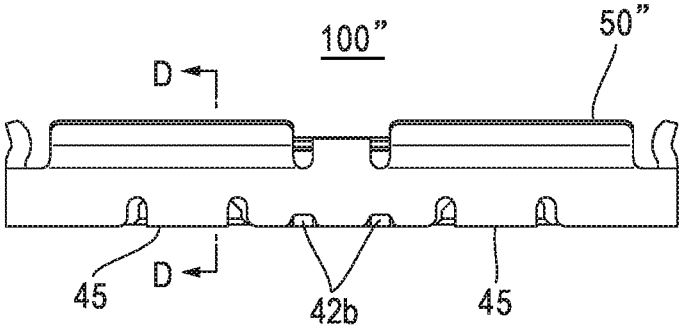
FIG. 19B is a front elevational view illustrating the connector illustrated in FIG. 19A.
Figure 19C:
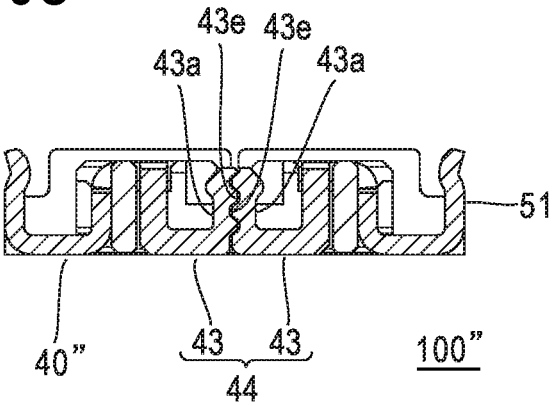
FIG. 19C is a sectional view taken along the D-D line in FIG. 19B.
Figure 20:
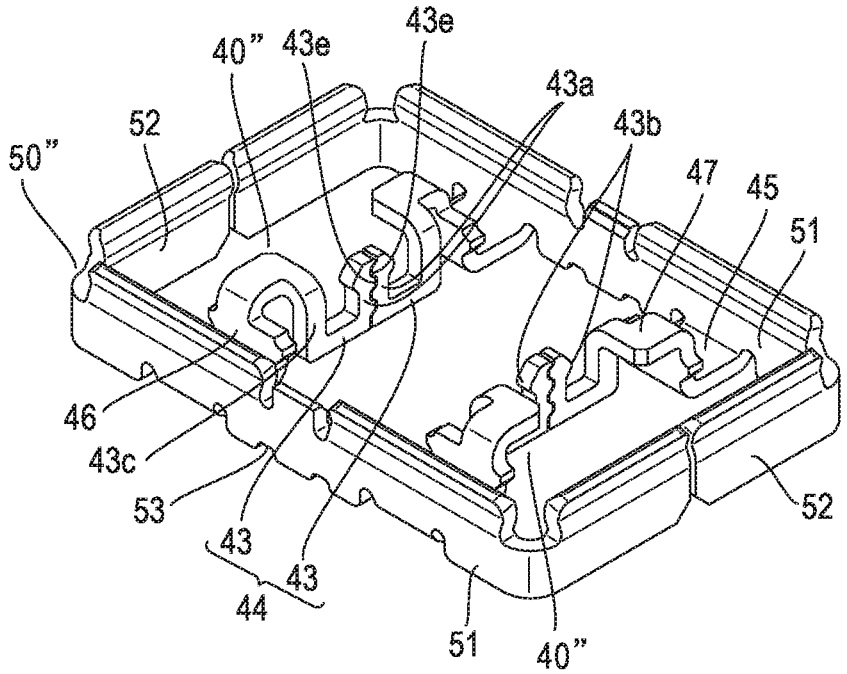
FIG. 20 is a perspective view illustrating ground terminals integrated with a shell illustrated in FIG. 19A.
Figure 21A:
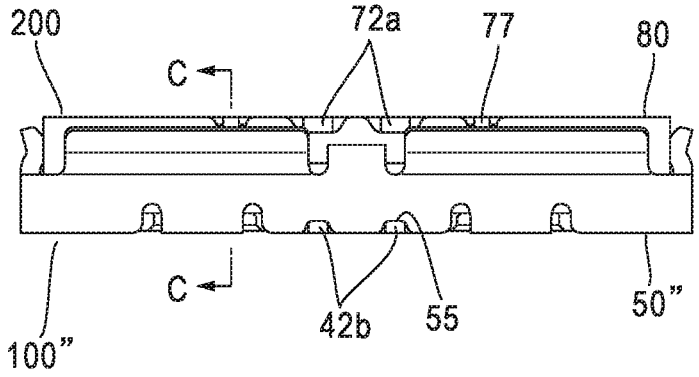
FIG. 21A is a front elevational view illustrating the connector assembly according to the third embodiment of the present invention.
Figure 21B:
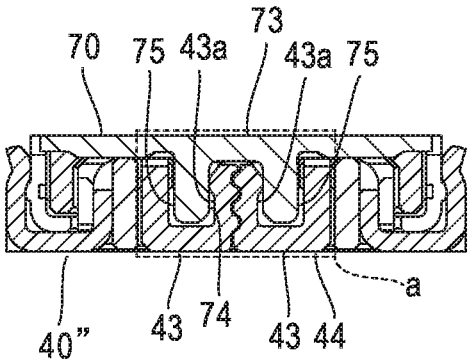
FIG. 21B is a sectional view taken along the C-C line in FIG. 21A.

FIGS. 19A, 19B, and 19C illustrate the structure of one connector 100" of a connector assembly according to a third embodiment of the present invention. FIG. 20 illustrates a shell 50" which is formed in the connector 100" in a manner to be integrated with ground terminals 40". Further, FIGS. 21A and 21B illustrate a state in which the connector 100" and a mating connector 200 are fitted to each other. Portions corresponding to those of the first embodiment will be provided with the same reference characters and detailed description thereof will be omitted.

In the third embodiment, the difference from the first embodiment is the shape of a pair of U-shaped portions 43 constituting a plate portion 44 of the ground terminal 40". Specifically, respective opposing surfaces 43*e* of leg portions 43*a*, which are inserted into a concave portion 74 of a mating plate portion 73, of mutually-adjacent U shapes in the pair of U-shaped portions 43 have zigzag shapes in this example. The zigzag shapes are formed along the extending direction of the leg portions 43*a* (the fitting direction between the connector 100" and the mating connector 200) and are formed so that the zigzag shapes of the leg portions 43*a* are engaged with each other with a slight gap therebetween.

Shaping the opposing surfaces 43*e* of the leg portions 43*a*, which are opposed to each other, in the zigzag shape, that is, forming a gap in the zigzag shape between the leg portions 43*a* enables enhancement in shielding performance.

The foregoing description of the embodiments of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector assembly in which a connector that includes a first terminal, a second terminal, and a ground terminal, the ground terminal including a plate portion positioned between the first terminal and the second terminal, and a mating connector that includes a first mating terminal, a second mating terminal, and a mating ground terminal are fitted to each other, the first mating terminal and the second mating terminal being connected with the first terminal and the second terminal respectively, the mating ground terminal including a mating plate portion positioned between the first mating terminal and the second mating terminal, wherein the plate portion and the mating plate portion have plate surfaces that are parallel to each other and are parallel to a fitting direction between the connector and the mating connector, and a range within which a thickness of one of the plate portion and the mating plate portion is located is within a range within which a thickness of the other is located, the plate portion is composed of a pair of U-shaped portions that are adjacent to each other, the mating plate portion is shaped to have a pair of projection portions forming a concave portion therebetween, the projection portions formed in a pair are respectively inserted and positioned in U shapes of the pair of U-shaped portions, each of adjacent leg portions of the mutually-adjacent U shapes in the pair of U-shaped portions is inserted and positioned in the concave portion, and protrusion portions that are formed on end sides of the adjacent leg portions of the adjacent U shapes in a manner to protrude mutually outward are respectively in contact with the projection portions formed in a pair.

2. The connector assembly according to claim 1, wherein a gap between the plate portion and the mating plate portion and a gap between the leg portions of the adjacent U shapes are smaller than a thickness of the plate portion and a thickness of the mating plate portion.

3. The connector assembly according to claim 1, wherein opposing surfaces of respective leg portions of the adjacent U shapes are formed to have zigzag shapes that extend in the fitting direction and are engaged with each other.

4. The connector assembly according to claim 2, wherein opposing surfaces of respective leg portions of the adjacent U shapes are formed to have zigzag shapes that extend in the fitting direction and are engaged with each other.

5. The connector assembly according to claim 1, wherein the ground terminal is integrated with a shell constituting an outer shell of the connector.

6. The connector assembly according to claim 2, wherein the ground terminal is integrated with a shell constituting an outer shell of the connector.

7. The connector assembly according to claim 3, wherein the ground terminal is integrated with a shell constituting an outer shell of the connector.

8. The connector assembly according to claim 4, wherein the ground terminal is integrated with a shell constituting an outer shell of the connector.

* * * * *